United States Patent [19]

Kropac

[11] 4,108,655

[45] Aug. 22, 1978

[54] METHOD OF MAKING A THERMO ACTIVE IMAGING MEMBER

[75] Inventor: Joseph M. Kropac, Williamson, N.Y.

[73] Assignee: Xerox Corporation, Stamford, Conn.

[21] Appl. No.: 445,767

[22] Filed: Feb. 25, 1974

[51] Int. Cl.[2] ..... G03G 13/22; G03G 5/04

[52] U.S. Cl. ..... 96/1.5 R; 427/74; 96/1 M; 427/375

[58] Field of Search ..... 427/74, 78, 82; 96/1 M, 96/1.5

[56] References Cited

U.S. PATENT DOCUMENTS

| | | | |
|---|---|---|---|
| 3,598,581 | 8/1971 | Reinis | 96/1 M |
| 3,653,889 | 4/1972 | Luebbe et al. | 96/1 M |

*Primary Examiner*—Roland E. Martin, Jr.
*Assistant Examiner*—John L. Goodrow

[57] ABSTRACT

A manifold imaging method and member is disclosed wherein the imaging layer is activated by a fused thermo-activator which is incorporated into the member by dispersion coating means. Upon heating, the thermo-activator activates the imaging layer for use in the manifold imaging process.

16 Claims, 3 Drawing Figures

METHOD OF MAKING A THERMO ACTIVE IMAGING MEMBER

BACKGROUND OF THE INVENTION

This invention relates to the manifold imaging process and more particularly to a novel thermally activated imaging member and method.

There has recently been discovered an imaging technique generally referred to as the manifold imaging method wherein an imaging member comprising a donor layer, imaging layer and receiver layer is employed. The imaging layer is electrically photosensitive and in one form comprises an electrically photosensitive material such as metal-free phthalocyanine dispersed in an insulating binder. Typically, the imaging layer is coated on the donor layer and the coated substrate combined is termed a donor. When needed, in preparation for the imaging operation, the imaging layer is activated as by contacting it with a swelling agent, softening agent, solvent or partial solvent for the imaging layer. The imaging layer is typically exposed to an imagewise pattern of light to which it is sensitive and while sandwiched between the donor and receiver layers and subjected to an electric field the imaging layer fractures upon the separation of the donor and receiver layers are subjected to an electric field the imaging layer fractures upon the separation of the donor and receiver layers providing complementary positive and negative images on the donor and receiver layers in accordance with the image to which it was exposed.

Such manifold imaging method is more fully disclosed in U.S. Pat. No. 3,707,368 to Van Dorn which patent is hereby incorporated by reference. As is taught in said patent the imaging layer is typically activated by applying thereto an activator material. Subsequent efforts in the manifold imaging science has produced other methods of activation such as thermo-activation as disclosed in U.S. Pat. No. 3,598,581 to Reinis which patent is hereby incorporated by reference. Although activation as disclosed by Reinis eliminates the need for handling liquid activators at the imaging site, such process provides a wax component on the final image and a carry-over in image background areas. There is desired a thermo-solvent activator method which reduces the amount of wax on the image and background areas.

The result of other work related to thermo-activation of a manifold imaging layer is described in copending U.S. Application Ser. No. 210,658 filed Dec. 22, 1971. The problem of wax carry-over and image background areas is reduced according to said copending application by placing the hot melt coated thermo-activator layer under the imaging layer rather than over it as disclosed in the Reinis patent. While such method reduces the amount of activator carry-over in background areas on the receiver there has been found several narrow process parameters such as coating thickness and activator temperature for optimum image quality.

SUMMARY OF THE INVENTION

It is therefore, an object of this invention to provide an improved manifold imaging method.

Another object of this invention is to provide a novel imaging member useful in the manifold imaging process having a thermo-activation capability of wide activation temperature range.

Another object of this invention is to provide a thermo manifold imaging process which provides images having reduced activator in background areas.

Another object of this invention is to provide a thermo-activated manifold imaging member which requires less thermo-activator to provide adequate activation of the imaging layer.

In accordance with this invention there is provided a manifold imaging member and method employing a thermo-activator layer wherein said activator is incorporated into the imaging member by means of dispersion coating techniques. By the term "dispersion coating" as employed in this specification and claims means a coating of small particles of thermo-activator out of a liquid vehicle. Upon coating, the residual liquid vehicle is removed as by evaporation leaving a layer of small particles of the thermo-activator. The particles are then melted or fused into a continuous, thin activator layer, placed either between the imaging layer and donor layer or between the imaging layer and receiver layer. Because it is mechanically easier to coat the imaging layer, the preferred method is to place the thermo-activator layer between the imaging layer and the receiver layer. Alternatively the activator can be divided by placing a portion of the activator between the donor layer and the imaging layer and the remainder between the receiver layer and the imaging layer. Furthermore, the activator can be coated on the receiver layer in accordance with this invention. Typical prior art thermo-activators, or solvents include those known in the prior art. The term "thermo-activator" or "thermo-solvent" is intended to mean those materials which have a melting point lower than the imaging layer which, upon melting, become an activator for the imaging layer. That is, the activator material structurally weakens or reduces the cohesive strength of the imaging layer such that the layer fractures in response to the combined effects of an applied electric field and exposure to electromagnetic radiation to which the layer is sensitive. In such weakened condition the layer cleaves or fractures in accordance with the imagewise exposure when the donor and receiver layers are separated. The amount of activator depends upon several factors such as the imaging layer material thickness of the imaging layers and the ability of the activator to soften or weaken the imaging layer.

The amount of activator is held to the minimum amount required for adequate activation. Typically, for most available materials the amount of activator is in the range of from about 0.5 g./sq.ft to about 2 g./sq.ft and preferably in the range of from about 0.6 to about 0.8 g./sq.ft. Particularly preferred thermo-activators are those which are solid at or slightly above room temperature but which melt below 175° F. Such thermo-activators include long chain petroleum waxes with from about 16 to about 37 carbon atoms in the chain. Typical waxes include hexadecane, heptadecane, octadecane, nonadecane eicosane, heneicosane, docosane, tricosane, tetracosane, pentacosane, octacosane, triacentane, dotriacontane, tetratriacontane, and octatriacontane and mixtures thereof. Other thermo-activators known in the art include m-terphenyl, Aroclors (chlorinated polyphenyls available from Monsanto Co., St. Lousi, Mo.), biphenyl, polybutenes and mixtures thereof.

A dispersion of the thermo-activator is formed most conveniently by first melting the thermo-activator and adding it to a liquid non-solvent which is held at a temperature below the melting point of the thermo-activator. The thermo-activator precipitates in the liquid and is dispersed as it precipitates by agitating the mixture. A dispersion is formed by then milling the mixture of liquid non-solvent and precipitated wax such as, for example, in a ball mill or attritor. Great care must be taken to avoid contamination during the milling step. The grist employed must be free of foreign material and must not introduce contamination which would be harmful to the imaging process. Stainless steel balls washed with an aromatic solvent such as benzene or toluene may be employed. Carefully cleaned flint stone pebbles are preferred. A more efficient milling means is an attritor mill with one quarter inch stainless steel balls such as Svedgari Attritor Impactor available from Union Process Co., Akron, Ohio.

Typical dispersions of this invention contain solid thermo-activator in the range of from about 5% to about 30% solids by weight. Preferably dispersions contain from about 8 to about 15% solids and is satisfactorily coated by typical dispersion coating means such as mayer rod doctoring, air knife doctoring and extrusion coating. The dispersion viscosity found to be suitable for such coating techniques is in the range of from about 40 to about 100 c.p.s. by dilution. Other viscosity ranges can be employed depending upon the coating means used. Preferably the dispersion contains about 12% solids.

In general, the manifold imaging materials in the prior art employing thermo-activated imaging layers are also useful in the member and process of this invention. Thus, typical thermoplastic, metal and paper donor and receiver layers of the prior art are also useful herein. In addition, the typical thermo-activated electrically photosensitive imaging layers of the prior art are employed herein.

Typical electrically photosensitive materials include organic as well as inorganic materials. Because of its sensitivity a preferred organic material is the *x* crystalline form of metal free phthalocyanine. Other forms of phthalocyanine are useful as well as substituted phthalocyanines well known in the art. Other organic materials include quinacridones, nitriles, imidazoles, triazines and pyrazolines as are known in the prior art. Inorganic materials include zinc oxide, mercuric sulfide, cadmium sulfide, zinc sulfide arsenic sulfide and various selenides. Organic materials including some of those listed above are preferable complexed with small amounts (up to about 5%) of Lewis acids which are well known in the art. Numerous other exemplary materials useful in the preparing the donor, receiver and imaging layers are listed in the above incorporated U.S. Pat. No. 3,598,581.

Here, as in the prior art, the thermo-activator to be employed is chosen so as to effect the desired activation of the imaging layer keeping in mind the electrically photosensitive materials and binders employed therein.

Typical binder materials include electrically insulating resins such as polythylene, polypropylenes, polybutylene, polyamides, polymethacrylates, epoxies, phenolics, hydrocarbon resins and natural resins such as rosin derivatives as well as mixtures thereof.

An advantage provided by the instant invention is the control over activator carry-over onto the image background areas. In accordance with this invention, the amount of activator left on the complementary images is concentrated on one image while the other image has relatively less activator. The imaging system is thus operated so as to take advantage of the control over activator carry-over. Activator carry-over is further controlled by the addition of small amounts of microcrystalline wax to the thermo-activator. Amounts up to about 4% by weight of the thermo-activator provide images wherein most of the activator is left on one image thus reducing the amount of activator on the other image. Any suitable microcrystalline wax can be employed. A typical microcrystalline wax is Paraflint RG available from the Moore and Munger Co.

In another embodiment of this invention the dispersion also contains sub-microscopic hydrophobic silica. Any suitable hydrophobic finely divided silica can be employed, such silica is commercially available under various tradenames and generally has a particle size in the range of from about 2 to about 30 millimicrons. Examples of such silicas are Silanox 101 and Organo-Sil available from the Cabot Chemical Company, Boston, Massachusetts and Aerosil R-972 available from Degussa Inc., New York, New York. Other similar gel forming silica products can be employed in accordance with this invention. Hydrophobic silica is a specially prepared product from silicon dioxide. A more complete description as several exemplary materials is found in U.S. Pat. No. 3,720,617 to Chaterji et al, which patent is heareby incorporated by reference.

The above described silica forms a gel with the thermo-activator and the gel layer is incorporated into the imaging member in any suitable location either under or over the imaging layer. Typically, the gel layer is provided by first mixing the thermo-activator in its melted, liquid state with an appropriate amount of silica as indicated above. The silica is added to the activator preferably with constant stirring. Depending upon the desired rigidity of the gel, amounts of from about 5% to about 30% by weight based upon the activator have found to be suitable in most instances. The melted activator/-silica mixture is precipitated in a non-solvent which, conveniently, is an alcohol. Typical alcohols whether employing silica or not, include ethanol, isopropanol, methanol, and other low molecular weight alcohols. The alcohol is preferably anhydrous. The precipitate is then milled to provide a dispersion of suitable particle size in the alcohol than coated from the dispersion onto either donor layer, imaging layer or receiver layer. The activator layer can be dried slowly at room temperature or the coating is heated to drive off the alcohol.

When employing elevated temperature to remove the alcohol after coating, care must be taken to avoid an alcohol-wax gel formation. In order to reduce the tendency of forming such a gel, a mixture of alcohols is employed to produce the dispersion. For example a 50/50 mixture, by weight, of ethanol and isopropanol can be employed at drying temperature in the range of from about 52° C to about 60° C. More preferably a mixture of 5% methanol, 5% isopropanol and 90% ethanol, by weight, provides acceptable drying temperatures in the range of from about 52° C to about 80° C. These and other mixtures can be employed to combine the best balance of quality between a dispersion medium and drying speed.

An advantage found with the present invention is the reduction in the amount of thermo-activator needed for adequate activation of the imaging layer. By reducing the amount of thermo-activator present in the imaging member the amount of such activator on the final image is reduced. In addition the member and process of this invention has been found to produce less activator transfer to the receiver than prior art methods thus enabling one to produce images on the receiver layer having much reduced amounts of activator in background areas as well as in the image itself.

BRIEF DESCRIPTION OF THE DRAWINGS

In order that the invention will be more clearly understood, reference is now made to the accompanying drawing in which an embodiment of the invention is illustrated by way of example.

DETAILED DESCRIPTION OF THE DRAWINGS

Figure 1:
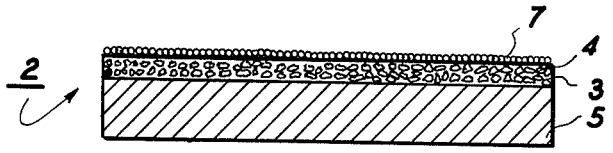
FIG. 1 is a side sectional view of a photosensitive imaging member of this invention as freshly coated with the thermo-activator, by dispersion coating techniques.

Referring now to FIG. 1, imaging layer 2 comprising photosensitive particles 4 dispersed in binder 3 is deposited on an insulating donor substrate 5. Thermo-activator 7 in particulate form rests upon imaging layer 2 having been coated thereon by dispersion coating techniques.

Figure 2:
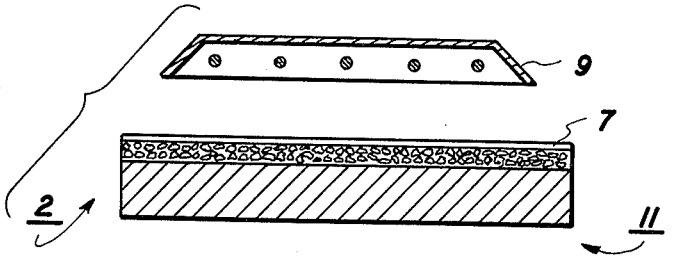
FIG. 2 is a side sectional view of the imaging member of this invention being heated subsequent to receiving a dispersion coating of the thermo-activator of this invention whereby a fused thermo-activation layer is produced.

Referring now to FIG. 2, there is shown heating element 9 radiating heat toward imaging member 11 thereby fusing together thermo-activator 7 into a continuous layer which permeates, in some cases, completely through imaging layer 2. As will be more particularly pointed out below, there has been discovered an advantage with respect to activator carry-over in fusing the dispersion coated activator layer. The layer is heated above its melting point so as to fuse it into a continuous layer and preferably allowing the activator to fill the rough surface of the imging layer. The activator is even more preferably allowed to penetrate through the electrically photosensitive imaging layer to the donor sheet surface. Typical fusing temperatures are in the ranges of from about 50° C depending upon the activator employed. For best activator carry-over results fusing temperatures in the range of from about 65° C to about 80° C are employed.

Figure 3:
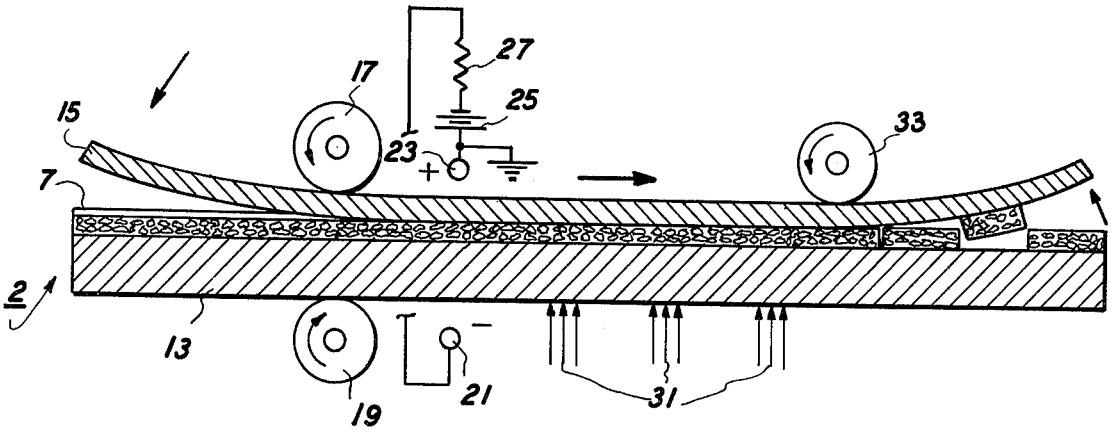
FIG. 3 is a side-sectional view diagrammatically illustrating the process steps of this invention.

Referring now to FIG. 3, the first step illustrated in the imaging process is the activation step. In this stage of the imaging process the manifold member comprising insulating donor layer 13, imaging layer 2, receiver layer 15, which in the illustration shown is electrically insulating, and the thermo-activator which in turn activates the imaging layer. Heated roller 19 can alternatively be in the form of a heated shoe or other heated support means in contact with donor layer 13. In addition a plurality of heated support means is employed so as to enable fast movement of the imaging member through the system. The activator serves to swell or otherwise weaken imaging layer 2. Once the desired physical properties have been imparted to imaging layer 2 the manifold set proceeds through electrodes 21 and 23 which are connected to potential source 25 through resistor 27. Electrodes 21 and 23 can take any suitable form for imparting an electrostatic charge to the layers. One such form is a pair of charged rollers in contact with the moving imaging set.

After receiving the electrostatic charge on each surface, the imaging member is advanced to imaging station 29 where it is exposed to light image 31. Light image 31 may be light projected through a transparency or may be light information projected from an opaque object. In continuous operation the light image preferably is projected through a slit scanning device so that there is little or no relative motion between the projected image and the manifold set during exposure. Although not shown, other sequences of method steps can occur. For example, suitably activated and charged imaging layer can be exposed to appropriate radiation before the sandwich is formed either through the donor layer as shown in FIG. 3 or directly upon its exposed surface. Thus opaque materials can be employed as the donor and receiver layers. Such a process is more fully described in U.S. Pat. No. 3,615,393 hereby incorporated by reference. Subsequent to exposure to electromagnetic radiation to which the imaging layer is sensitive, receiver layer 15 is separated from donor layer 13 over roller 33 thus fracturing the imaging layer in accordance with the light image to which the imaging layer was exposed. There is thus formed a negative image on one of the donor and receiver layers a positive image on the other.

DESCRIPTION OF THE PREFERRED EMBODIMENTS

The following examples further specifically illustrate the various embodiments of the improved imaging member and method. The parts and percentages are of a weight unless otherwise indicated.

EXAMPLE I

An imaging layer is prepared by first mixing 2.5 grams of x-form metal-free phthalocyanine with about 1.2 grams of Algol Yellow GC, 1,2,5,6-di(C,C'-diphenyl) thiazoleanthraquinone, C. I. No. 67300, available from GAF and about 2.8 grams of purified Irgazine 2 BLT available from Geigy Chemical Co. The mixture is milled in a ball mill for 4 hours with 60 ml of a hydrocarbon solvent available under the trade name DC Naphtha 2032 from The Standard Company of Ohio, Cleveland, Ohio.

A binder is prepared by first dissolving 3 parts of Polyethylene DYLT, 1.5 parts of Paraflint RG, 0.5 parts of Elvax 420 and 2.5 parts of Piccotex 75 in 20 ml. of Sohio Odorless Solvent 3440 by heating the mixture with stirring. The solution was allowed to cool and the resulting paste added to the milled pigment. The pigment/paste mixture is ball milled for about 16 hours. The milled paste is then placed in a polyethane jar, heated in a water bath at a temperature of 65° C for about 2 hours, allowed to cool and slurried in about 70 parts of 2-propanol. The paste-like mixture is then coated on 1 mil donor of Mylar (a polyester formed by the condensation reaction between ethylene glycol and terephthalic acid available from E. I. DuPont de Nemours & Co. Inc.) with a No. 22 wire-wound drawdown rod to produce a coating thickness when dried of approximately 8 to 10 microns averaging about 0.21 grams of imaging material per square foot. The coating on the 1 mil Mylar sheet is then dried in the dark at a temperature of about 43° C for 5 minutes.

A gel is then prepared by combining, with constant stirring, 1.5 parts of a hydrophobic silica, Aerosil R-972 with 18 parts of melted paraffin wax obtained from the Will Scientific Corp. Rochester, New York, under the trade name Bioloid Embeddding Compound. The mixture is precipitated in 100 ml. of an alcohol mixture of 5% isopropanol, 5% methanol and 90% ethanol, allowed to cool to room temperature, then ball milled to form a dispersion in the alcohol. The dispersion is then coated over the above prepared imaging layer by means of a #36 wire wound drawdown rod and dried for 5 minutes at 65° C. in a forced-air oven. A 1 mil Mylar receiver is placed on a grounded electrode heated to 54° C. The donor, with imaging layer towards the receiver is placed on the heated receiver. The activator melts and the sandwich is charged by passing a 9KV corona discharge device over it. After charging, the imaging layer is exposed to an imagewise pattern of incandescent light at a total energy of 0.40 foot candle seconds. While heated, the donor and receiver layers are separated providing a positive image of the original on the donor layer and a negative image on the receiver.

EXAMPLE II

The procedure of Example I is repeated except 3%, by weight of the paraffin wax, of microcrystalline wax available under the tradename Paraflint RG from the Moore & Munger Co. is added to the wax/silica mixture while melted. Similar results of image formation are obtained.

EXAMPLE III

A bench test has been developed to determine quickly and accurately the amount of thermo-activator carry-over onto the receiver layer which test correlates well to results obtained during actual image formation. The bench test repeats the procedure of Example I with the exception that no imagewise exposure of the imaging layer occurs. The amount of thermo-activator on the receiver sheet, expressed as weight per unit area, is determined by weighing the receiver sheet before and after the procedure.

The effect of various drying times and temperatures during the preparation of the thermo-activator layer of this invention on activator carry-over is determined by means of the above described bench test and the results described in Table I below. The amount of transfer to the receiver is expressed in percent of activator present in the imaging members. The imaging member is constructed as described in Example I or II as indicated in Table I under the "Material" column.

TABLE I

| Material (Example) | Drying Time Minutes | Drying Temp. C. | Activator Coating Wt. g./sq. ft. | Imaging Layer Coating Wt. g./sq. ft. | Activator Transfer % |
|---|---|---|---|---|---|
| I | 5 | 55 | .63 | .21 | 39.9 |
| I | 5 | 65 | .65 | .21 | 40.0 |
| I | 5 | 75 | .65 | .21 | 30.8 |
| I | 5 | 85 | .65 | .21 | 21.5 |
| I | 15 | 55 | .64 | .21 | 40.6 |
| I | 15 | 65 | .63 | .21 | 39.7 |
| I | 15 | 75 | .62 | .21 | 25.8 |
| I | 15 | 85 | .63 | .21 | 20.6 |
| II | 5 | 55 | .66 | .21 | 42.2 |
| II | 5 | 65 | .61 | .21 | 24.6 |
| II | 5 | 75 | .61 | .21 | 19.7 |
| II | 5 | 85 | .63 | .21 | 11.1 |
| II | 15 | 55 | .65 | .21 | 38.5 |
| II | 15 | 65 | .65 | .21 | 26.1 |
| II | 10 | 75 | .67 | .21 | 20.9 |
| II | 15 | 75 | .66 | .21 | 21.2 |
| II | 10 | 85 | .63 | .21 | 13.6 |
| II | 15 | 85 | .65 | .21 | 12.3 |

EXAMPLE IV

A series of determinations of activator carry-over is made to demonstrate the effect of drying time and temperature of the dispersion coated imaging layer. It is to be noted that the drying temperature raises the temperature of the thermo-activator coating so as to fuse the particles of activator into a continuous layer and as the temperature increases to allow the activator to permeate the imaging layer. The following procedure is employed in the preparation and coating of the dispersion in each deterimination.

A dispersion is prepared by first melting about 54 grams of Bioloid Embedding Compound (50°–52° C) and combining the melted wax with about 300 ml of the alcohol mixtures of Example I at room temperature with constant stirring. The wax solidifies in the alcohol while stirring continuous for about 15 minutes. The alcohol with the solid particles of wax is then added to a 500 ml. polyethylene bottle ½ filled with ¼ inch stainless steel pellets, Type 440 from the Pioneer Steel Ball Co., Unionville, Conn.; previously cleaned with several washes of benzene followed by acetone washing and finally several anhydrous alcohol washes. The dispersion is milled at room temperature overnight at 125 rpm. The thus prepared dispersion is then coated onto an imaging layer prepared as described in Example I by means of a #28 wire-wound draw down rod.

The thus prepared imaging member is employed in the process as described in Example III to determine the wax transfer to the receiver as indicated in Table II below.

TABLE II

| Drying Time Minutes | Drying Temp. ° C | Activator Coating Weight g/sq. ft. | Imaging Layer Coating Weight g/sq. ft. | Activator % Carryout |
|---|---|---|---|---|
| 15 | 55 | .55 | .21 | 40 |
| 15 | 65 | .55 | .21 | 34.5 |
| 15 | 75 | .56 | .21 | 33.9 |
| 15 | 85 | .53 | .21 | 26.4 |
| 10 | 75 | .58 | .21 | 37.9 |
| 5 | 55 | .58 | .21 | 43.1 |
| 5 | 65 | .56 | .21 | 39.3 |
| 5 | 75 | .53 | .21 | 37.7 |
| 5 | 85 | .56 | .21 | 34.5 |

EXAMPLES V & VI

A wax dispersion is prepared in accordance with the procedure of Example I in double quantity and coated onto two sheets of 1 mil thick Mylar donor layers by means of a No. 30 wire wound drawdown rod. The coating is dried 5 minutes at 65° C to form a fused dispersion coated thermo-activator layer.

Two batches of pigments are prepared having the following composition in each batch:

| | | |
|---|---|---|
| x-phthalocyanine | 2.5g | 2.5g |
| Irgazine Red 2BLT (purified) | 2.8g | 2.8g |
| Algol Yellow GC Conc. (") | 1.2g | 1.2g |
| DC Naphtha 2032 (") | 60 ml | 60 ml |

The pigments and vehicles are placed in a 250 ml polyethylene bottle filled ½ to ⅓ full of ½ inches to ⅝ inches flint pebbles and milled for 4 hours at 125 r.p.m.

Two batches of binder materials are prepared having the following compositions:

| | | |
|---|---|---|
| Polyethylene DYLT (purified) | 3.0g | 3.0g |
| Piccotex 75 | 2.5g | 2.5g |
| Elvax 420 (purified) | 0.5g | 0.5g |
| Paraflint RG | 1.5g | 1.5g |
| Sohio 3440 Solvent (purified) | 20 ml | — |

-continued

| | | |
|---|---|---|
| DC Naphtha 2032 (purified) | — | 20 ml |

Each binder composition is prepared by dissolving the components in the vehicle, Sohio 3440 Solvent (Example V) and DC Naphtha 1032 (Example VI), by heating the vehicle. The hot, clear solution is cooled to room temperature thus forming a fine precipitate of paste-like consistency.

A batch of pigments is added to each binder paste in a 250 ml bottle. The mixtures are milled for 16 hours at 125 r.p.m. and then heated in a water bath at 65° C for 2 hours. To each hot mixture there is added 200 ml of reagent grade 2-propanol by adding 100 ml to each bottle, thus transferring its contents, including the flint stones to a 500 ml bottle. The other 100 ml of 2-propanol are used to rinse the 250 ml bottle and are combined in the 500 ml bottle. The mixtures are then milled for an additional ½ hours and filtered through a medium porosity sintered glass funnel. The 500 ml bottle is rinsed with 30 ml of 2-propanol which is added to the filter cake. Each wet cake (40% to 50% solids by weight) is then dispersed in 120 ml of 2-propanol and coated over the fused, dispersion coated thermo-activator layers by means of a #18 wire wound drawdown rod to form two imaging layers. The layers are dried in a forced air oven for 5 minutes at 60° C.

Two imaging members are formed by placing a 1 mil thick Mylar sheet over each imaging layer. Each member is then charged, activated by heating the donor layer and exposed to an imagewise pattern of light according to the procedure of Example I. Upon separation of the donor and receiver layers a positive image is found and the donor layer and an optical negative image with a relatively small amount of thermoactivator is found on the receiver layer in each instance.

The above Examples illustrate various illustrative embodiments of this invention. As indicated by the Examples many variables are controlled in the preparation of the imaging member and activator dispersion of this invention. It has further been found that particle size of the activator at the time of coating affects the amount of activator required for adequate activation and thus the amount of activator transferred to the receiver. Hence, smaller particle size of the activator when coated from the dispersion is preferred. Although activator transfer is minimal in the instance of drying at 85° C some image deterioration is observed.

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging layer. For example various dyes, spectral sensitizers or electrical sensitizers such as Lewis acids may be added to the several layers.

Other modifications and ramifications of the present invention will occur to those skilled in the art upon a reading of the present disclosure. These are intended to be included within the scope of this invention.

What is claimed is:

1. A method of preparing a thermo-activated imaging member comprising a donor layer, a receiver layer and sandwiched therebetween a thermo-activator layer in contact with an electrically photosensitive imaging layer capable of being rendered structurally fracturable in response to the combined effects of an applied electric field and exposure to electromagnetic radiation to which said imaging layer is sensitive by means of contact with said thermo-activator at a temperature above the melting point of said activator which comprises the step of:

(1) providing said imaging layer coated on said donor layer;

(2) dispersion coating a thermo-activator onto said imaging layer, and;

(3) fusing said activator into a continuous layer over said imaging layer.

2. The method of claim 1 wherein said dispersion coating is carried out with a dispersion of paraffin wax dispersion in an alcohol.

3. The method of claim 2 wherein said activator layer is fused at a temperature at a range of from about 65° C to about 80° C.

4. The method of claim 1 further including the step of placing a receiver layer over said fused activator layer.

5. The method of claim 1 whereas said donor layer is transparent to said electromagnet radiation.

6. The method of claim 4 wherein said receiver layer is transparent.

7. The method of claim 5 wherein said thermoactivator comprises a paraffin wax.

8. The method of claim 1 wherein said dispersion comprises a thermo-activator and a finely divided hydrophobic silica.

9. The method of claim 1 wherein said dispersion comprises a paraffin wax thermo-activator, a finely divided hydrophobic silica and a micro-crystalline wax.

10. A method of preparing a thermo-activated imaging member comprising a donor layer, a reveiver layer and sandwiched therebetween a thermo-activator layer in contact with an electrically photosensitive imaging layer capable of being rendered structurally fracturable in response to the combined effects of an applied electric field and exposure to electromagnetic radiation to which said imaging layer is sensitive by means of contact with said thermo activator layer at a temperature above the melting point of said activator which comprises the steps of:

(2) dispersion coating a thermo-activator onto said donor layer;

(3) fusing said thermo-activator into a continuous layer over said imaging layer, and;

(4) coating said electrically photosensitive imaging layer over said fused thermo-activator layer.

11. The method of claim 10 wherein said dispersion comprises a paraffin wax dispersed in a low molecular weight alcohol.

12. The method of claim 11 wherein said thermoactivator layer is fused at a temperature in the range of from about 65° C to about 80° C.

13. The method of claim 12 wherein the said dispersion also contains a finely divided hydrophobic silica.

14. The method of claim 13 wherein said dispersion also contains a microcrystalline wax.

15. The method of claim 10 further including the step of placing a receiver layer over said imaging layer.

16. The method of claim 10 wherein said donor layer is transparent.

* * * * *